US009095028B2

(12) United States Patent
Peck et al.

(10) Patent No.: US 9,095,028 B2
(45) Date of Patent: Jul. 28, 2015

(54) METHOD AND APPARATUS FOR MONITORING LED BEACON LIGHTS

(71) Applicant: Dialight Corporation, Farmingdale, NJ (US)

(72) Inventors: John Patrick Peck, Manasquan, NJ (US); Kevin A. Hebborn, Toms River, NJ (US)

(73) Assignee: Dialight Corporation, Farmingdale, NJ (US)

( * ) Notice: Subject to any disclaimer, the term of this patent is extended or adjusted under 35 U.S.C. 154(b) by 98 days.

(21) Appl. No.: 13/732,069

(22) Filed: Dec. 31, 2012

(65) Prior Publication Data

US 2014/0184071 A1 Jul. 3, 2014

(51) Int. Cl.
*H05B 37/02* (2006.01)
*H05B 33/08* (2006.01)

(52) U.S. Cl.
CPC ..... *H05B 33/0854* (2013.01); *H05B 33/0893* (2013.01)

(58) Field of Classification Search
CPC ..... H05B 33/0803; H05B 33/0842; H05B 33/0806; H05B 37/0254; H05B 37/0272; H05B 33/0815; H05B 33/0854; H05B 33/0893; H05B 37/0218; H05B 33/0821; H05B 33/0851; H05B 37/0227; H05B 37/0263; H05B 37/0281; H05B 33/0884; H05B 37/029; H05B 37/034; Y02B 20/48; B60Q 1/26; B60Q 3/048; B60Q 3/06; F21K 9/00
USPC ..... 315/88, 90, 292, 297, 362, 312, 79, 80, 315/86; 340/815.45, 815.65, 963; 362/372, 362/489
See application file for complete search history.

(56) References Cited

U.S. PATENT DOCUMENTS

| | | | | |
|---|---|---|---|---|
| 3,964,040 | A | 6/1976 | Behl | |
| 6,448,716 | B1 | 9/2002 | Hutchison | |
| 6,717,376 | B2 * | 4/2004 | Lys et al. | 315/292 |
| 6,753,762 | B1 | 6/2004 | Gonzalez | |
| 2008/0258628 | A1 * | 10/2008 | Higley et al. | 315/86 |
| 2010/0156303 | A1 | 6/2010 | Wulff | |
| 2011/0084615 | A1 | 4/2011 | Welten | |
| 2011/0215735 | A1 | 9/2011 | Herbst et al. | |
| 2012/0236558 | A1 * | 9/2012 | Roudeski et al. | 362/235 |
| 2012/0306377 | A1 * | 12/2012 | Igaki et al. | 315/151 |
| 2012/0319871 | A1 * | 12/2012 | Wise | 340/961 |

OTHER PUBLICATIONS

PCT International Search Report and Written Opinion of PCT/US2013/78283, May 1, 2014, pp. 1-9.

* cited by examiner

*Primary Examiner* — Haiss Philogene

(57) ABSTRACT

The present disclosure is directed to a method, computer-readable medium and apparatus for monitoring a plurality of light emitting diode (LED) light banks for each one of a plurality of LED beacon lights. In one embodiment, the method includes determining an amount of ambient light, selecting an operating mode for each one of the plurality of LED beacon lights based upon the amount of ambient light, determining a value of a threshold for the operating mode that is selected, receiving a light output value of each one of the plurality of LED beacon lights, comparing the light output value of each one of the plurality of LED beacon lights to the predetermined value of the dynamic threshold and generating an alarm when the light output value of any one of the plurality of LED beacon lights falls below the predetermined value of the dynamic threshold.

17 Claims, 7 Drawing Sheets

INITIALIZATION, NIGHT, RED SYSTEM INSTALLED

METHOD AND APPARATUS FOR MONITORING LED BEACON LIGHTS

BACKGROUND

A beacon light can be used to mark an obstacle that may provide a hazard to vehicles, aircrafts and boats. In some cases, such as aircraft obstruction warning beacons, the beacon light must be monitored to determine if it is functioning. Previously, the beacons were checked visually by an observer on a daily basis. However, towers can be as high as 2,000 feet and may require as many as 30 lights. As a result, visually checking the beacon lights by an observer may not be practical.

SUMMARY

In one embodiment, the present disclosure provides a method, computer-readable medium and apparatus for monitoring a plurality of light emitting diode (LED) light banks for each one of a plurality of LED beacon lights. In one embodiment, the method includes determining an amount of ambient light, selecting an operating mode for each one of the plurality of LED beacon lights based upon the amount of ambient light, determining a value of a threshold for the operating mode that is selected, receiving a light output value of each one of the plurality of LED beacon lights, comparing the light output value of each one of the plurality of LED beacon lights to the value of the threshold and generating an alarm when the light output value of any one of the plurality of LED beacon lights falls below the value of the threshold.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are, therefore, not to be considered limiting of its scope for the disclosure may admit to other equally effective embodiments.

DETAILED DESCRIPTION

As discussed above, beacon lights are used to mark an obstacle that may provide a hazard to vehicles, aircrafts and boats. The obstacles may be elevated structures, e.g., towers, that are hundreds of feet tall. The beacons lights must be monitored to determine if it is functioning. However, due to the height of the obstacles, it may be difficult to check the beacon lights visually. In addition, climbing towers for maintenance is expensive and inconvenient.

One embodiment of the present disclosure provides a communication system for electronically monitoring a plurality of light emitting diode (LED) light banks for each one of a plurality of LED beacon lights. As a result, the communication system may automatically determine if a particular LED light bank of a particular LED beacon light has failed for a particular operating mode and generate alarm messages. In addition, the communication system may attempt to power up alternate LED light banks if possible.

Figure 1:
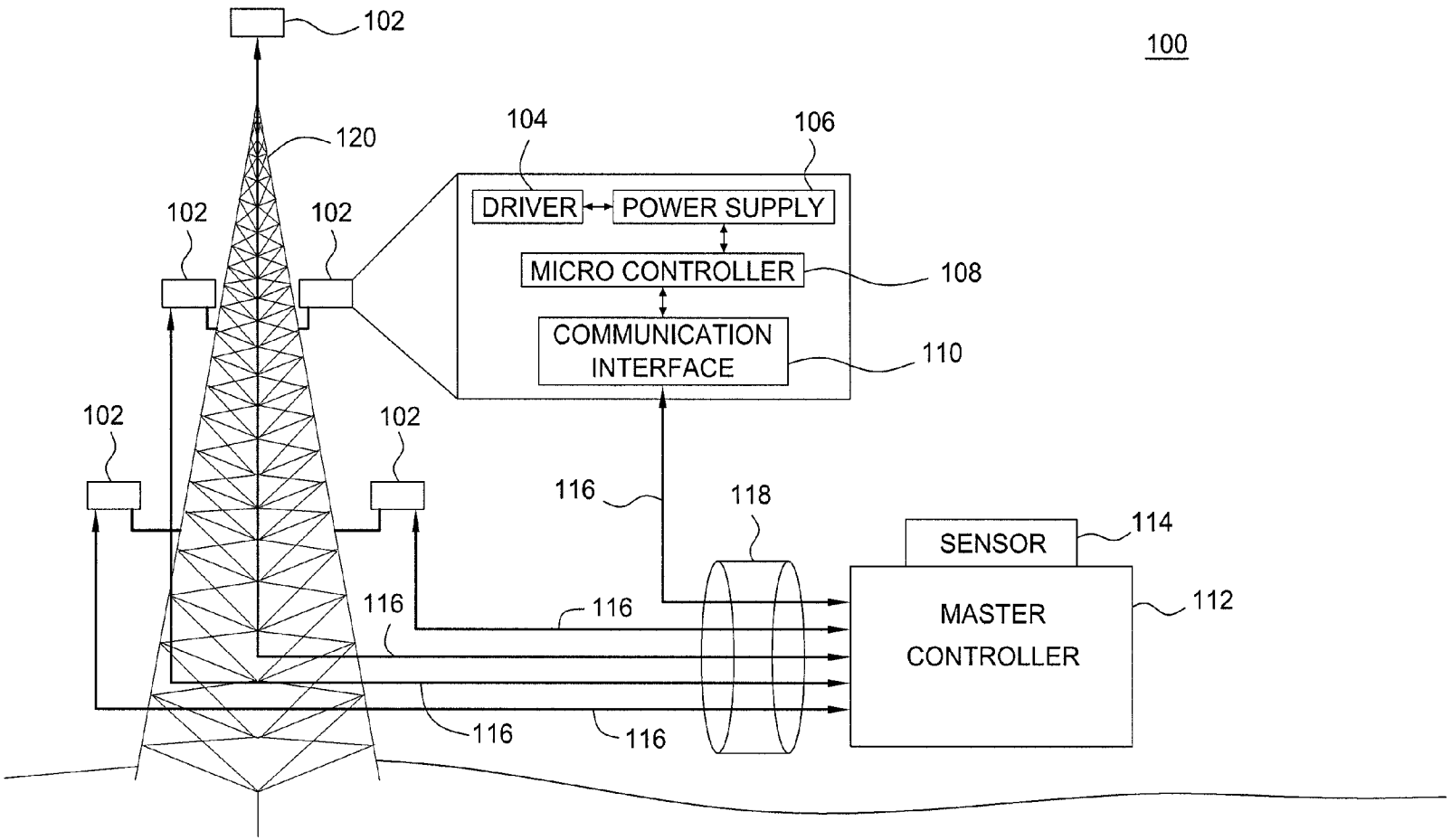
FIG. 1 depicts an example of a communication system for monitoring LED beacon lights on a tower.

FIG. 1 illustrates an example of a communication system 100 for monitoring LED beacon lights on an elevated structure, e.g., a tower, a smokestack, a structure deployed at the top of a building, e.g., a pole, or an antenna, and the like. In one embodiment, the communication system 100 includes a tower 120 having a plurality of LED beacon lights 102. In one embodiment, the LED beacon lights 102 may be also referred to as an obstruction light or a signal light. The tower 120 may be a light tower, an antennae tower, a smoke stack, or any other obstruction that is hundreds of feet tall.

FIG. 1 also illustrates a blown up box of one of the LED beacon lights 102 that illustrates a block diagram of some of the internal components of the LED beacon lights 102. In one embodiment, the LED beacon lights 102 may each include an LED driver 104, a power supply 106, a microcontroller 108 and a communication interface 110.

In one embodiment, the power supply 106 may convert an alternating current (AC) supply such as 120 Volts(V), 240V, 277V or 480V, for example, to suitable direct current (DC) voltages required by a driver, a microcontroller and one or more communications circuits. In one embodiment, the communication interface 110 may provide an electrical communication connection 116 to communicate with a master controller 112 over a wired connection, for example a RS-485 wired connection or a fiber optic connection. In one embodiment, the master controller 112 may be embodied as a general purpose computer illustrated in FIG. 7 and discussed below. In one embodiment, the master controller 112 may be located on a ground level such that it is easily accessible by a technician. In addition, the master controller 112 may be located remotely from the LED beacon lights 102.

Figure 2:
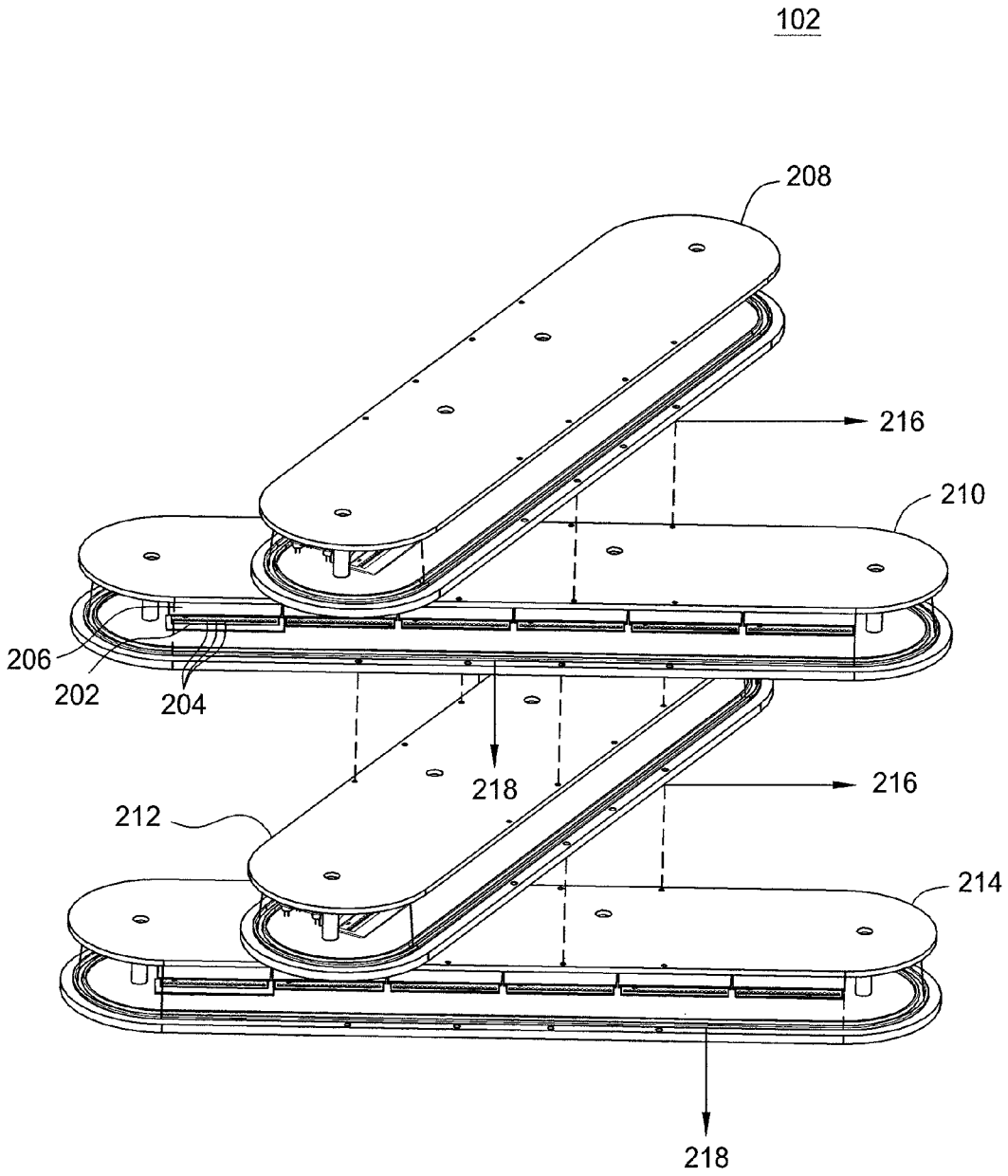
FIG. 2 depicts an example of an LED beacon light.

FIG. 2 illustrates one embodiment of a more detailed view of the LED beacon light 102. The LED beacon light 102 may include a plurality of LED light banks 202. Each one of the plurality of LED light banks 202 may include a plurality of LEDs 204. Each one of the plurality of LEDs 204 of each one of the plurality of LED light banks 202 may be arranged in an approximate line that is at a focal distance from a respective reflector 206.

In one embodiment, the LED beacon light 102 may have multiple levels. For example, FIG. 2 illustrates the LED beacon light 102 having a first level 208, a second level 210, a third level 212 and a fourth level 214. In one embodiment, the LED beacon light 102 may have more than four levels or less than four levels. In one embodiment, the LED beacon light 102 may have multiple levels that combined emit light outward over 360 degrees in a horizontal direction. In one embodiment, each one of the LED light banks 202 may emit light in a particular direction marked by arrows 216 and 218. The directions illustrated in FIG. 2 are provided only as an example configuration and it should be noted that the LED beacon light 102 may emit light in more directions (e.g., 4 directions or 8 directions) without departing from the scope of the present disclosure.

In one embodiment, each one of the LED light banks 202 may have a unique identifier or address. In other words, every LED light bank 202 on each level 208, 210, 212 and 214 of the LED beacon light 102 may have a unique identifier. The unique identifier may be an alphanumeric address that include numbers, letters, symbols or a combination of both. In other words, if one of the LED light banks 202 fails, the master controller 112 may be able to identify the failed LED light bank 202 by the respective unique identifier such that a technician may know exactly which LED light bank 202 in which LED beacon light 102 at which level on the tower 120 has failed.

Referring back to FIG. 1, in one embodiment, the master controller 112 may be in electrical communication with each one of the LED beacon lights 102 with a respective electrical communication connection 116. In one embodiment, all of the electrical communication connections 116 may be run to each one of the LED beacon lights 102 via a common conduit 118. In one embodiment, the electrical communication connections 116 may be a bus network and configured in a ring network, a mesh network, a star network, a line network, a tree network or a fully connected network. In one embodiment, the master controller 112 may have the ability to control each one of the plurality of LED light banks 202 of each one of the LED beacon lights 102 by sending a control signal to the respective unique identifier of each one of the plurality of LED light banks 202.

In one embodiment, the master controller 112 may have a light sensor 114. In one embodiment, the light sensor 114 may measure an amount of ambient light. For example, the ambient light may be the amount of light in an outdoor environment where the tower 120 is located.

Figure 4:
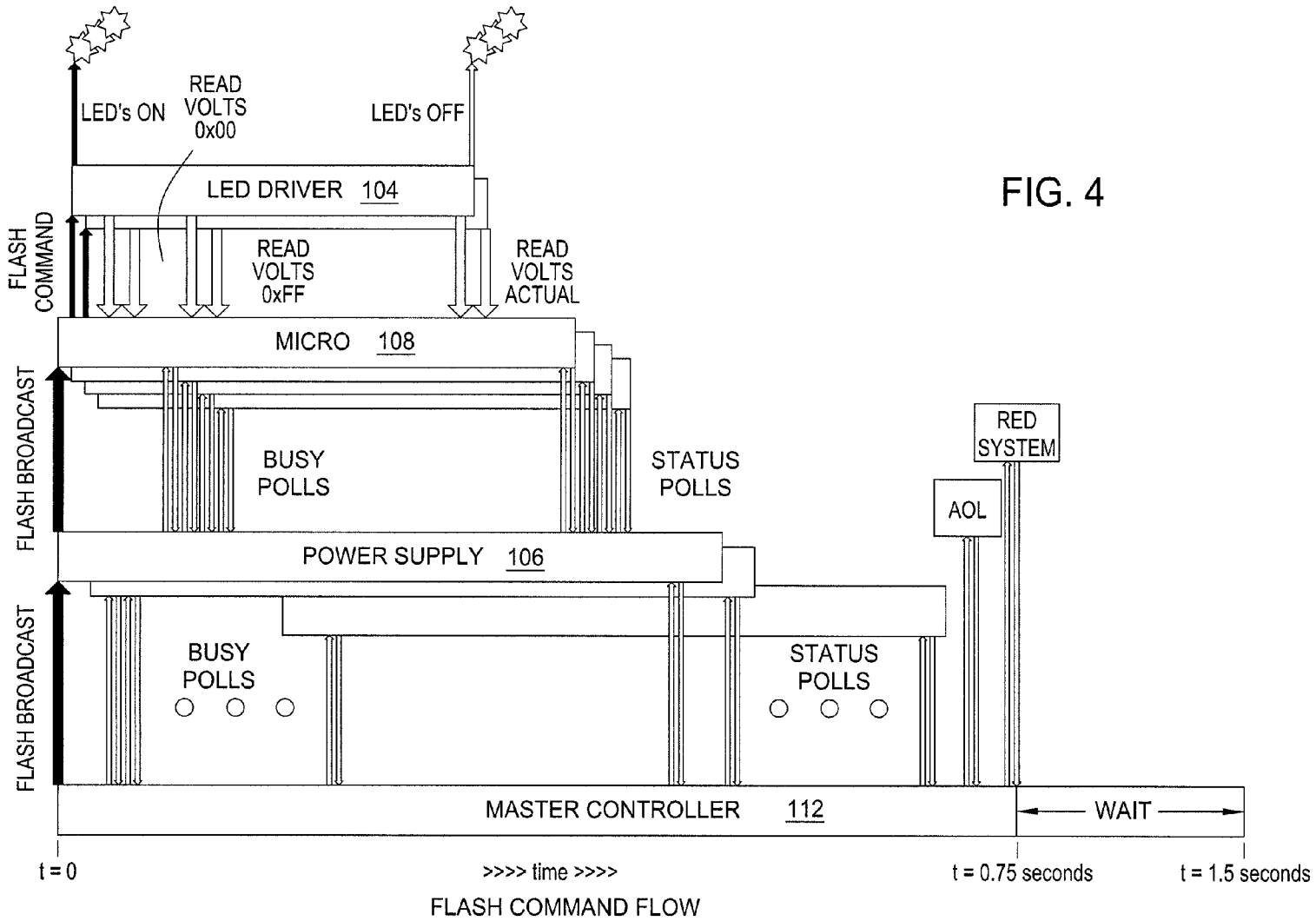
FIG. 4 depicts an example communication flow for a flash command.

The amount of ambient light may be used to determine an operating mode of each one of the LED beacon lights 102. For example, each one of the LED beacon lights 102 may operate in one of a plurality of different operating modes. In one embodiment, the plurality of different operating modes may include a day mode, a twilight mode and a night mode. Each one of the different operating modes may require a different amount of light output. In addition, the different amount of light output may be achieved by the LED beacon light 102 differently via control signals sent and controlled by the master controller 112. FIG. 4 illustrates one example of a communication flow for a flash command between the master controller 112, the power supply 106, the microcontroller 108 and the LED driver 104.

Figure 5:
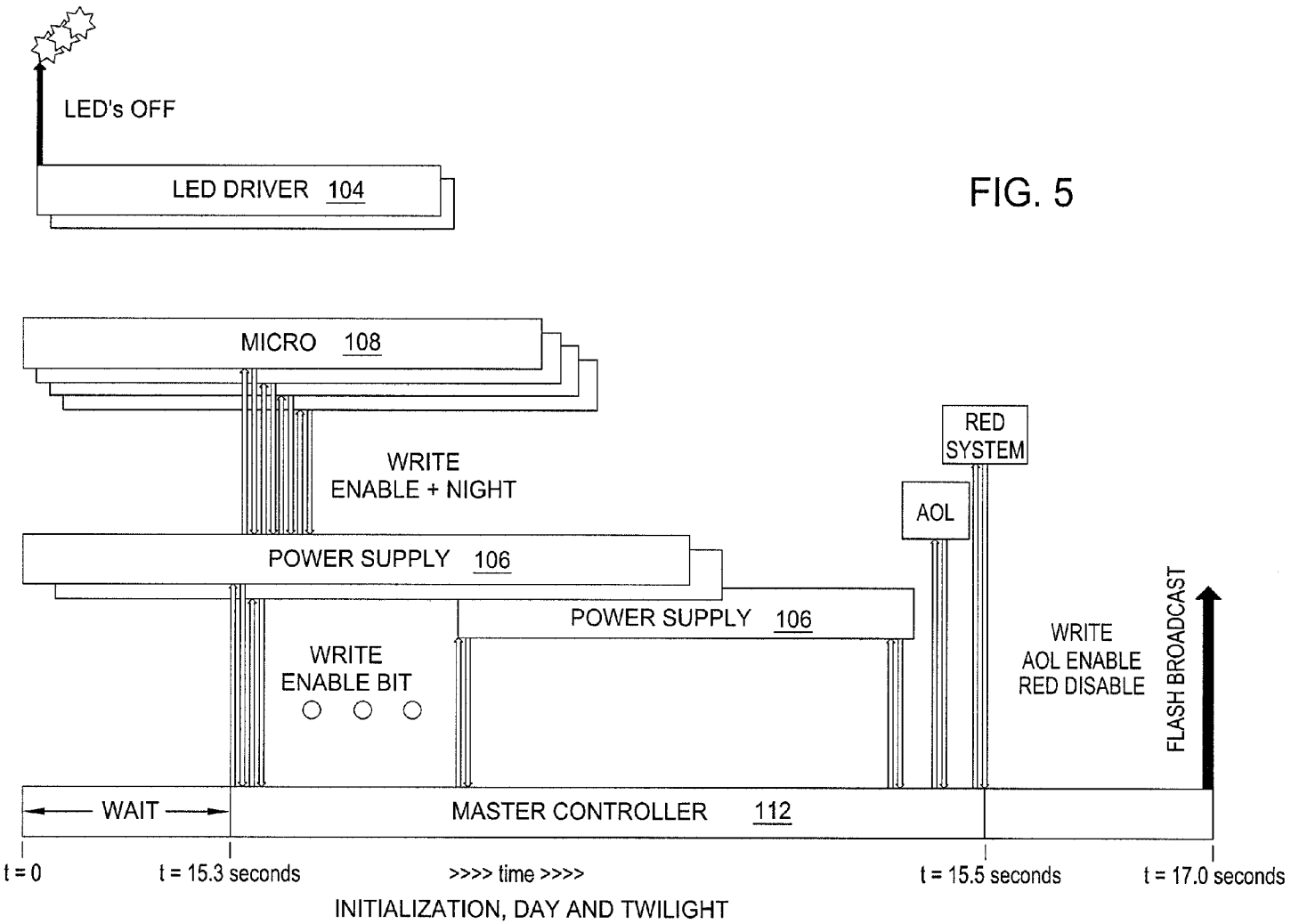
FIG. 5 depicts an example communication flow for a day and twilight mode.

In one embodiment, the day mode may require that the LED beacon light 102 produce at least 200,000 candelas of light. The LED beacon light 102 may produce the 200,000 candelas of light by powering on all of the LED light banks 202. FIG. 5 illustrates one example of a communication flow for the day mode between the master controller 112, the power supply 106, the microcontroller 108 and the LED driver 104.

In one embodiment, the twilight mode may require that the LED beacon light 102 produce at least 20,000 candelas of light. The LED beacon light 102 may produce the 20,000 candelas of light by powering on a single bank of LED light banks 202. FIG. 5 also illustrates one example of a communication flow for the twilight mode between the master controller 112, the power supply 106, the microcontroller 108 and the LED driver 104. Notably, the communication flow for the day mode and the twilight mode may be the same except that the communication flow is to only a single bank of the LED light banks 202 in the twilight mode versus all of the LED light banks 202 in the day mode.

Figure 6:
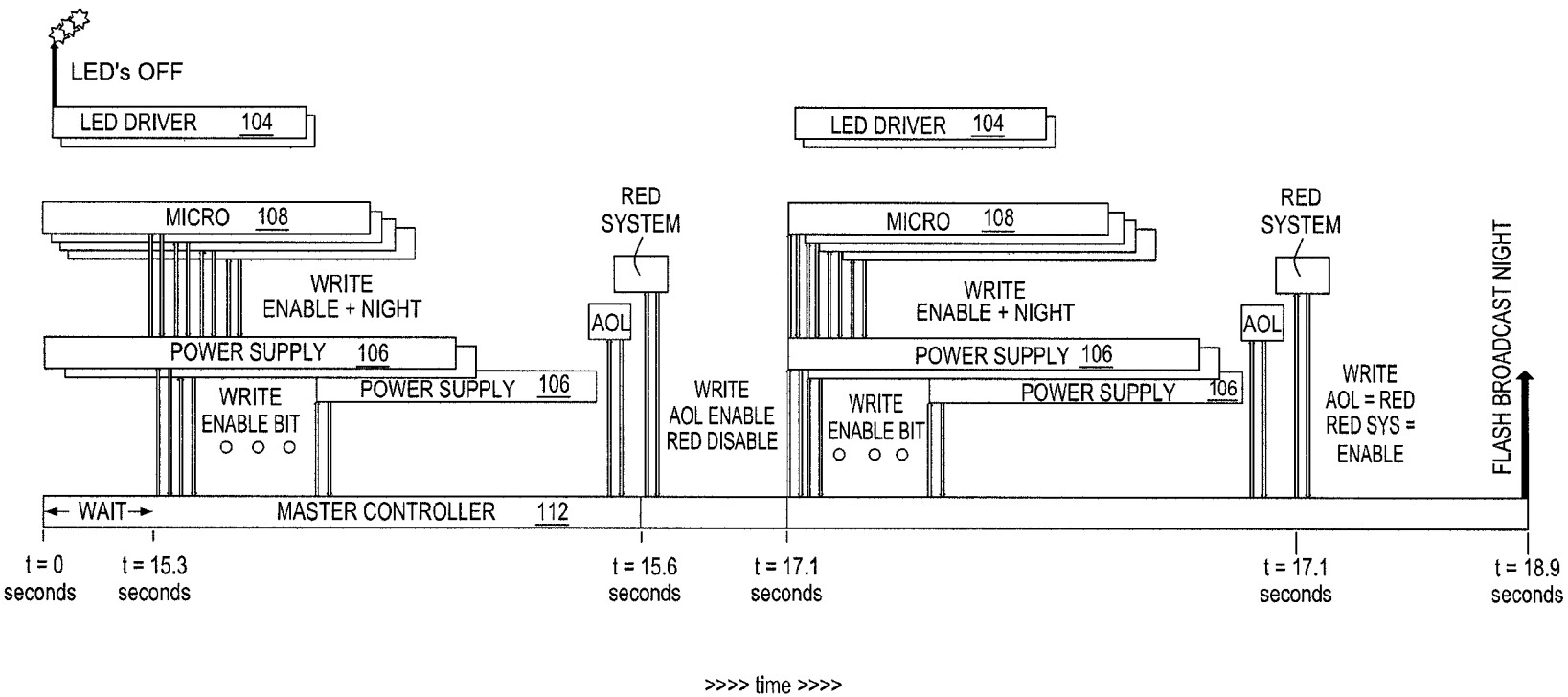
FIG. 6 depicts an example communication flow for a night mode.

In one embodiment, the night mode may require that the LED beacon light 102 produce at least 2,000 candelas of light. The LED beacon light 102 may produce the 2,000 candelas of light by pulse modulating a single bank of the LED light banks 202. FIG. 6 illustrates one example of a communication flow for the night mode between the master controller 112, the power supply 106, the microcontroller 108 and the LED driver 104.

It should be noted that other communication flows may exist. For example, the master controller 112 may issue a long flash command, e.g., a blinking light, or a short flash command, e.g., a strobe light. The master controller 112 may control the duration of the flash, e.g., to have the same consecutive durations or different consecutive durations. The use of different flash durations may be used to provide specification information to a pilot. FIG. 5 illustrates one example of a communication flow for a flash command between the master controller 112, the power supply 106, the microcontroller 108 and the LED driver 104.

In one embodiment, the master controller 112 may monitor each one of the plurality of LED light banks 202 of each one of the plurality LED beacon lights 102 to ensure that the minimum light output required for a particular mode are being met. In one embodiment, master controller 112 may receive information with respect to the amount of light output for each one of the plurality of LED light banks 202 of each one of the plurality LED beacon lights 102. The light output value may then be compared to a dynamic threshold that has a different predetermined value for each one of the different operating modes. For example, the day mode operation may have a predetermined value of 200,000 candelas as the dynamic threshold, the twilight mode operation may have a predetermined value of 20,000 candelas as the dynamic threshold and the night mode operation may have a predetermined value of 2,000 candelas as the dynamic threshold.

The light output value may be calculated in various ways. In one embodiment, the light output value may be calculated based upon a simple percentage of operating LED lights 204 within each one of the plurality of LED light banks 202. For example, in a day mode if at least 75% of the LED lights 204 in each one of the plurality of LED light banks 202 is operating, the master controller 112 may assume that the LED beacon light 102 has a light output value of at least 200,000 candelas. Conversely, if 25% of the LED lights 204 in any one of the plurality of LED light banks 202 fails in a particular direction 216 or 218, then the master controller 112 may assume that at least 200,000 candelas of light output is not being produced.

In another embodiment, the master controller 112 may calculate an exact light output value based upon a voltage drop and/or a current across each one of the plurality of LED lights 204 in each one of the plurality of LED light banks 202. In one embodiment, the voltage drop and/or the current may be measured each time the plurality of LED lights 204 flash. For example, a certain amount of light output may be correlated to a certain voltage drop. The master controller 112 may receive a voltage drop reading for each one of the LED lights 204 over the communication system 100 illustrated in FIG. 1. The master controller 112 may then calculate the light output value based upon the voltage drop readings of each one of the LED lights 204 and determine if the light output is above or below the predetermined value of the dynamic threshold for a particular operating mode.

In one embodiment, the current may also be monitored across each one of the plurality of LED lights 204 in each one of the plurality of LED light banks 202 to ensure the current is within a predetermined range. The current, in conjunction with the voltage drop, may also be used to calculate a power delivered to each one of the plurality of LED lights 204. In turn, the power may be used to estimate a light output of each one of the plurality of LED lights 204 of each one of the plurality of light banks 202.

In one embodiment, if the light output value is below the predetermined value of the dynamic threshold, then the master controller 112 may generate an alarm. For example, the master controller 112 may output on a display the failed LED light bank or banks 202 and provide the unique identifier for each one of the failed LED light bank or banks 202.

In one embodiment, master controller 112 may also generate alarms for communication failures. For example, if the master controller 112 requests a status from each one of the plurality of LED beacon lights 102 and does not receive a response with a predefined period of time, e.g., within 6 seconds, the master controller 112 may assume there is a communication failure and generate an alarm. The master controller 112 may also generate alarms if the LED beacon lights 102 provides an unexpected response to the status request.

In one embodiment, the unique identifier may allow the master controller 112 to request a light output value for each one of the LED light banks 202. In other words, the communication from the LED light banks 202 to the master controller 112 is not simply a push communication, but rather may be a two-way communication that allows the master controller to request information individually and on demand from a specific LED light bank of the LED light banks 202 using the respective unique identifier.

Each one of the plurality of LED beacon lights 102 may provide various types of status reports to the master controller 112 in response to the status request. For example, the status reports may include an indication that the LED beacon lights 102 has received a flash command, that the LED beacon lights 102 has flashed, that the LED beacon lights 102 will flash, that the LED beacon lights 102 is in the middle of a flash, an electrical measurement (e.g., the voltage drop or current of an LED 204 or a LED light bank 202) of the LED beacon lights 102, and the like.

In one embodiment, if an alternate or back-up LED light bank 202 is available, the master controller 112 may automatically attempt to power up the alternate or back-up LED light bank 202. For example, in twilight mode or night mode only a single LED light bank 202 may be powered on, e.g., the LED light bank 202 on the first level 208 pointing in the direction 212. If the LED light bank 202 on the first level 208 pointing in the direction 216 fails, the master controller 112 may automatically generate an alarm, shut down the LED light bank 202 on the first level 208 pointing in the direction 216 and power on the LED light bank 202 on the third level 212 pointing in the same direction 216.

In a further embodiment, power may be cycled to various LED light banks over flash sequences. That is to say that in twilight mode, for example, a first LED light bank may be powered for the first flash and a second LED light bank may be powered for the second flash and so on. Therefore, a failure of a single LED light bank would only cause every other flash to miss. If power is cycled through six LED light banks, then a flash would only be missed every sixth time.

Figure 3:
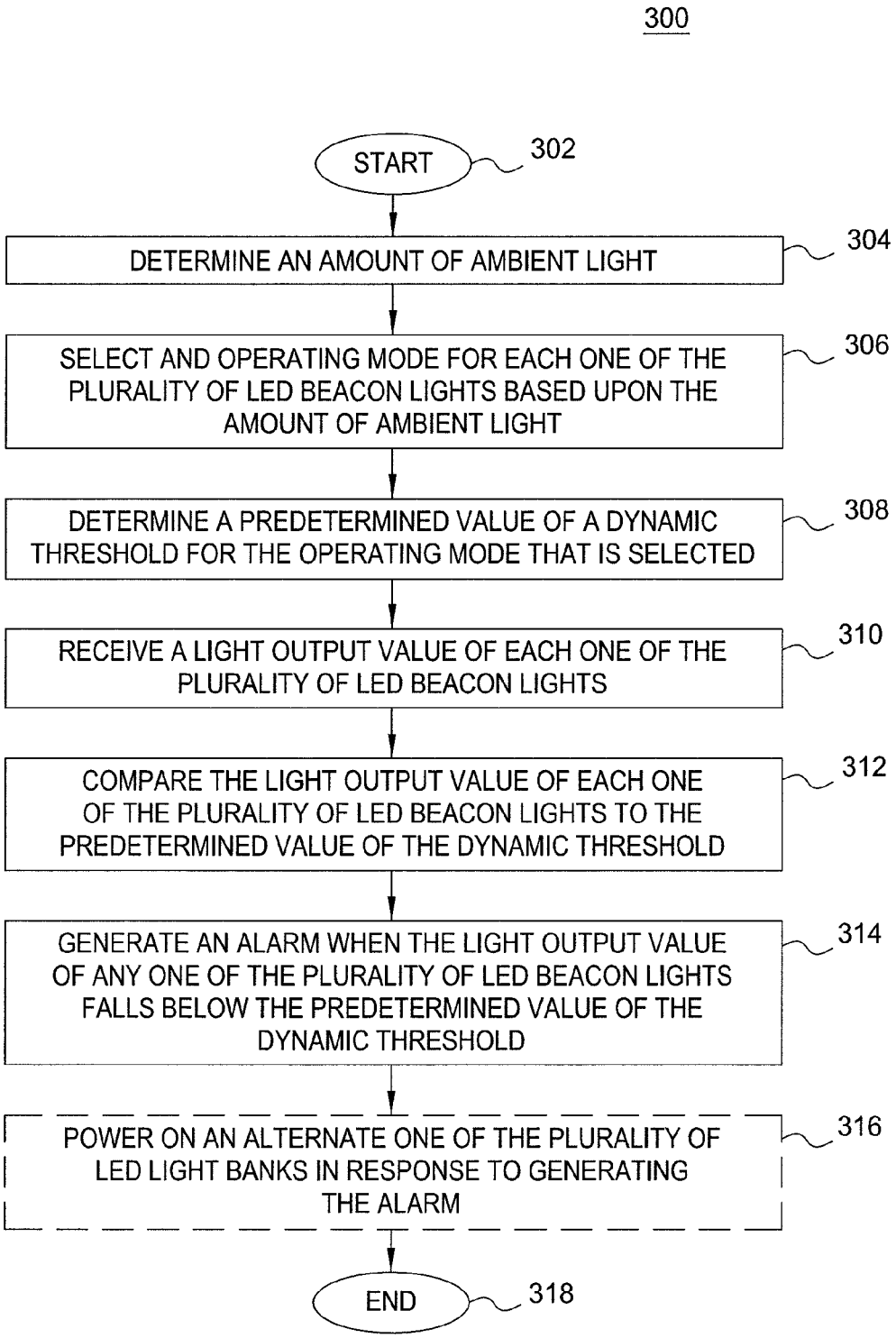
FIG. 3 depicts an example flow diagram of a method for monitoring a plurality of LED light banks for each one of a plurality of LED beacon lights.

FIG. 3 illustrates an example flowchart of one embodiment of a method 300 for monitoring a plurality of LED light banks for each one of a plurality of LED beacon lights. In one embodiment, the method 300 may be performed by a master controller 112 or a general purpose computer 700 illustrated in FIG. 7 and discussed below.

The method 300 begins at step 302. At step 304, the method 300 determines an amount of ambient light. For example, a light sensor on the master controller may measure the amount of light in an outdoor environment where a tower equipped with the plurality of LED beacon lights is located.

At step 306, the method 300 selects an operating mode for each one of the plurality of LED beacon lights based upon the amount of ambient light. For example, each one of the plurality of LED beacon lights may operate in one of three different operating modes including a day mode, a twilight mode and a night mode. Notably, the operating mode is not determined based upon a time of day. This is due to the fact that a cloudy day may reduce the amount of ambient light in the middle of the afternoon or a thunderstorm the afternoon may reduce the amount of ambient light to level that it appears to be dark outside. Thus, by selecting an operating mode based upon an ambient light level, an operating mode may be more accurately chosen.

At step 308, the method 300 determines a predetermined value of a dynamic threshold for the operating mode that is selected. For example, the day mode operation may have a predetermined value of 200,000 candelas as the dynamic threshold, the twilight mode operation may have a predetermined value of 20,000 candelas as the dynamic threshold and the night mode operation may have a predetermined value of 2,000 candelas as the dynamic threshold.

At step 310, the method 300 receives a light output value of each one of the plurality of LED beacon lights. The light output value may be calculated in various ways. In one embodiment, the light output value may be calculated based upon a simple percentage of operating LED lights within each one of the plurality of LED light banks. For example, in a day mode if at least 75% of the LED lights in each one of the plurality of LED light banks is operating, the master controller may assume that the LED beacon light has a light output value of at least 200,000 candelas.

In another embodiment, the master controller may calculate an exact light output value based upon a voltage drop across each one of the plurality of LED lights in each one of the plurality of LED light banks. In one embodiment, the voltage drop may be measured each time the plurality of LED lights flash. For example, a certain amount of light output may be correlated to a certain voltage drop. The master controller may receive a voltage drop reading for each one of the LED lights over the communication system. The master controller may then calculate the light output value based upon the voltage drop readings of each one of the LED lights and determined if the light output is above or below the predetermined value of the dynamic threshold for a particular operating mode.

At step 312, the method 300 compares the light output value of each one of the plurality of LED beacon lights to the predetermined value of the dynamic threshold. At step 314, the method 300 generates an alarm when the light output value of the any one of the plurality of LED beacon lights falls below the predetermined value of the dynamic threshold. For example, the master controller may output on a display the failed LED light bank or banks and provide the unique identifier for each one of the failed LED light bank or banks.

The method 300 may then perform optional step 316. At optional step 316, the method 300 powers on an alternate one of the plurality of LED light banks in response to generating the alarm. For example, in twilight mode or night mode only a single LED light bank may be powered on, e.g., an LED light bank on an upper level 208 pointing in a particular direction. If the LED light bank on the upper level pointing in the particular direction fails, the master controller may shut down the LED light bank on the upper level pointing in the particular direction and power on alternate LED light bank on a lower level that is pointing in the same particular direction. The method 300 ends at step 318.

Figure 7:
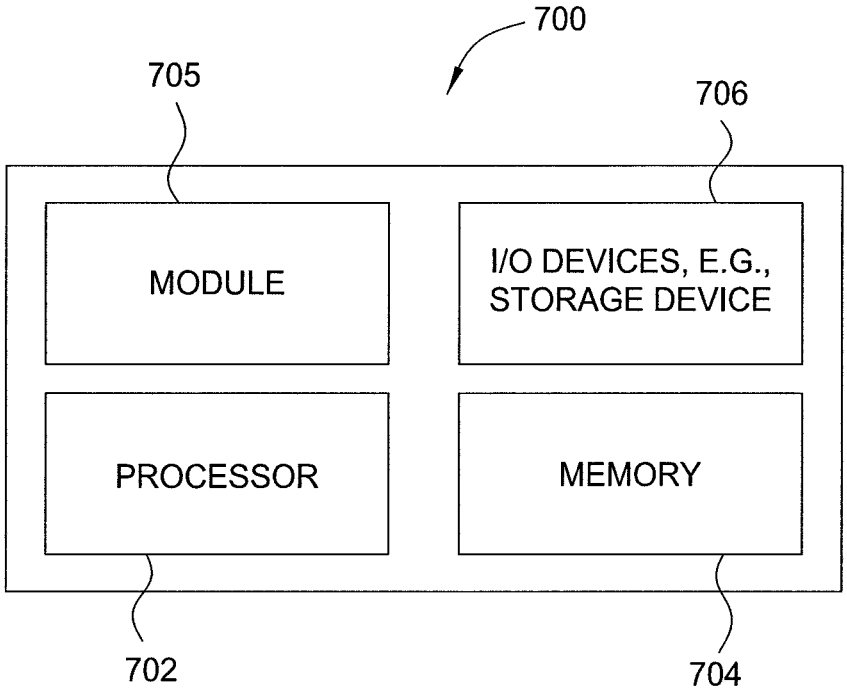
FIG. 7 depicts a high-level block diagram of a general-purpose computer suitable for use in performing the functions described herein.

FIG. 7 depicts a high-level block diagram of a general-purpose computer suitable for use in performing the functions described herein. As depicted in FIG. 7, the system 700 comprises a processor element 702 (e.g., a CPU), a memory 704, e.g., random access memory (RAM) and/or read only memory (ROM), a module 705 for monitoring a plurality of LED light banks for each one of a plurality of LED beacon lights, and various input/output devices 706 (e.g., storage devices, including but not limited to, a tape drive, a floppy drive, a hard disk drive or a compact disk drive, a receiver, a transmitter, a speaker, a display, a speech synthesizer, an output port, and a user input device (such as a keyboard, a keypad, a mouse, and the like)).

It should be noted that the present disclosure can be implemented in software and/or in a combination of software and hardware, e.g., using application specific integrated circuits (ASIC), a general purpose computer or any other hardware equivalents, e.g., computer readable instructions pertaining to the method(s) discussed above can be used to configure a hardware processor to perform the steps of the above disclosed methods. In one embodiment, the present module or process 705 for monitoring a plurality of LED light banks for each one of a plurality of LED beacon lights can be loaded into memory 704 and executed by processor 702 to implement the functions as discussed above. As such, the present method 705 for monitoring a plurality of LED light banks for each one of a plurality of LED beacon lights (including associated data structures) of the present disclosure can be stored on a non-transitory (e.g., physical and tangible) computer readable storage medium, e.g., RAM memory, magnetic or optical drive or diskette, and the like. For example, the hardware processor 702 can be programmed or configured with instructions (e.g., computer readable instructions) to perform the steps, functions, or operations of method 300 and the communication flows in FIGS. 4-6.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method for monitoring a plurality of light emitting diode (LED) light banks for each one of a plurality of LED beacon lights, comprising:

determining, by a processor, an amount of ambient light;

selecting, by the processor, an operating mode for each one of the plurality of LED beacon lights based upon the amount of ambient light;

determining, by the processor, a value of a threshold for the operating mode that is selected, wherein the value of the threshold for a minimum amount of light output is different for each one of a plurality of operating modes, wherein the plurality of operating modes comprises a day time mode that produces at least a first amount of light output, a twilight mode that produces at least a second amount of light output and a night time mode that produces at least a third amount of light output, wherein the first amount of light output, the second amount of light output and the third amount of light output are different amounts of light output;

receiving, by the processor, a light output value of each one of the plurality of LED beacon lights;

comparing, by the processor, the light output value of each one of the plurality of LED beacon lights to the value of the threshold; and generating, by the processor, an alarm when the light output value of any one of the plurality of LED beacon lights falls below the value of the threshold.

2. The method of claim 1, further comprising:

in response to generating the alarm, powering on an alternate one of the plurality of LED light banks.

3. The method of claim 1, wherein the light output value is calculated based upon a voltage drop across a respective one of the plurality of LED beacon lights.

4. The method of claim 1, each one of the plurality of LED banks for each one of the plurality of LED beacon lights comprises a unique identifier.

5. The method of claim 4, wherein the alarm provides a respective unique identifier of one of the plurality of LED banks that is failing.

6. The method of claim 2, wherein the alternate one of the plurality of LED light banks emits light in a same direction as a failed one of the plurality of LED light banks.

7. A tangible computer-readable medium to store a plurality of instructions which, when executed by a processor, cause the processor to perform operations for monitoring a plurality of light emitting diode (LED) light banks for each one of a plurality of LED beacon lights, the operations comprising:

determining an amount of ambient light;

selecting an operating mode for each one of the plurality of LED beacon lights based upon the amount of ambient light;

determining a value of a threshold for the operating mode that is selected, wherein the value of the threshold for a minimum amount of light output is different for each one of a plurality of operating modes, wherein the plurality of operating modes comprises a day time mode that produces at least a first amount of light output, a twilight mode that produces at least a second amount of light output and a night time mode that produces at least a third amount of light output, wherein the first amount of light output, the second amount of light output and the third amount of light output are different amounts of light output;

receiving a light output value of each one of the plurality of LED beacon lights;

comparing the light output value of each one of the plurality of LED beacon lights to the value of the threshold; and generating an alarm when the light output value of any one of the plurality of LED beacon lights falls below the value of the threshold.

8. The tangible computer-readable medium of claim 7, further comprising:

in response to generating the alarm, powering on an alternate one of the plurality of LED light banks.

9. The tangible computer-readable medium of claim 8, wherein the alternate one of the plurality of LED light banks emits light in a same direction as a failed one of the plurality of LED light banks.

10. The tangible computer-readable medium of claim 7, wherein the light output value is calculated based upon a voltage drop across a respective one of the plurality of LED beacon lights.

11. The tangible computer-readable medium of claim 7, each one of the plurality of LED banks for each one of the plurality of LED beacon lights comprises a unique identifier.

12. The tangible computer-readable medium of claim 11, wherein the alarm provides a respective unique identifier of one of the plurality of LED banks that is failing.

13. An apparatus for monitoring a plurality of light emitting diode (LED) light banks for each one of a plurality of LED beacon lights, comprising:

a processor; and a tangible computer-readable medium storing a plurality of instructions which, when executed by the processor, cause the processor to perform operations, the operations comprising:

determining an amount of ambient light;

selecting an operating mode for each one of the plurality of LED beacon lights based upon the amount of ambient light;

determining a value of a threshold for the operating mode that is selected, wherein the value of the threshold for a minimum amount of light output is different for each one of a plurality of operating modes, wherein the plurality of operating modes comprises a day time mode that produces at least a first amount of light output, a twilight mode that produces at least a second amount of light output and a night time mode that produces at least a third amount of light output, wherein the first amount of light output, the second amount of light output and the third amount of light output are different amounts of light output;

receiving a light output value of each one of the plurality of LED beacon lights;

comparing the light output value of each one of the plurality of LED beacon lights to the value of the threshold; and generating an alarm when the light output value of any one of the plurality of LED beacon lights falls below the value of the threshold.

14. The apparatus of claim 13, each one of the plurality of LED banks for each one of the plurality of LED beacon lights comprises a unique identifier.

15. The apparatus of claim 14, wherein the alarm provides a respective unique identifier of one of the plurality of LED banks that is failing.

16. The apparatus of claim 13, further comprising:

in response to generating the alarm, powering on an alternate one of the plurality of LED light banks, wherein the alternate one of the plurality of LED light banks emits light in a same direction as a failed one of the plurality of LED light banks.

17. The apparatus of claim 13, wherein the light output value is calculated based upon a voltage drop across a respective one of the plurality of LED beacon lights.

* * * * *